US006186762B1

(12) United States Patent
Matthes

(10) Patent No.: US 6,186,762 B1
(45) Date of Patent: Feb. 13, 2001

(54) PRESSURE ROLLER UNIT

(75) Inventor: Michael Matthes, Berlin (DE)

(73) Assignee: Korsch Pressen GmbH (DE)

( * ) Notice: Under 35 U.S.C. 154(b), the term of this patent shall be extended for 0 days.

(21) Appl. No.: 09/010,525

(22) Filed: Jan. 21, 1998

(30) Foreign Application Priority Data

Jan. 31, 1997 (DE) ..... 197 05 092

(51) Int. Cl.[7] ..... B30B 11/08
(52) U.S. Cl. ..... 425/193; 425/345
(58) Field of Search ..... 425/344, 345, 425/211, 193; 118/200, DIG. 15

(56) References Cited

U.S. PATENT DOCUMENTS

| | | | | |
|---|---|---|---|---|
| 839,156 | * | 12/1906 | Kliewer | 425/345 |
| 1,844,700 | * | 2/1932 | Stokes | 425/345 |
| 2,997,741 | * | 8/1961 | Crossley | 425/345 |
| 3,891,375 | * | 6/1975 | Pilewski et al. | 425/344 |
| 4,168,137 | * | 9/1979 | McLain et al. . | |
| 5,066,211 | * | 11/1991 | Wunder et al. | 425/345 |
| 5,151,280 | * | 9/1992 | Arndt et al. | 425/345 |
| 5,229,044 | * | 7/1993 | Shimada et al. . | |
| 5,686,118 | * | 11/1997 | Kurata | 425/344 |

FOREIGN PATENT DOCUMENTS

| | | | |
|---|---|---|---|
| 165401 | * | 9/1904 | (DE) . |
| 1 933 490 | * | 4/1970 | (DE) . |
| 0 460 295 A1 | * | 12/1991 | (EP) . |
| 2 252 917 | * | 6/1975 | (FR) . |

* cited by examiner

*Primary Examiner*—James P. Mackey
(74) *Attorney, Agent, or Firm*—McGlew and Tuttle, P.C.

(57) ABSTRACT

A pressure roller unit for rotary presses, especially for preparing tablets, with a frame lockable at the rotary press and with two bearing blocks, which can be adjusted at the frame and carry the pressure rollers. To absorb stronger pressing forces and to extensively relieve the press frame of the pressing forces, the frame is formed from a guide column (1), and the bearing blocks (20) are arranged at upper and lower pressure roller mounts (2 and 3), which are guided by the guide column (1) and are adjustable in relation to one another.

14 Claims, 5 Drawing Sheets

PRESSURE ROLLER UNIT

FIELD OF THE INVENTION

The present invention pertains to a pressure roller unit for rotary presses, especially for preparing tablets, with a frame lockable at the rotary press and with two bearing blocks which are adjustable at the frame and carry the pressure rollers.

BACKGROUND OF THE INVENTION

Such pressure roller units are used in rotary presses which comprise a frame, a rotor with drive, upper and lower rockers, which guide upper and lower pressure rollers, a frame housing, corner connections, and a cover plate. The forces occurring during the pressing process are directly introduced into the cover plate and the frame via the punches and the rockers and induce vibrations in these membrane-like components due to the pressing forces. These vibrations lead to considerable noise emissions.

A pressure roller unit of this type has been known from U.S. Pat. No. 3,891,375. In this pressure roller unit, the frame comprises upper and lower crossbeams, which are connected by vertical braces, and two columns arranged between these, on which the bearing blocks of the pressure rollers are slidable. The frame is mounted pivotably around a vertical axis in the press frame and forms a part of the press housing in the closed position. The frame may be pivoted by about 90° from a working position into the open position, in which case the drive of the pressure rollers is uncoupled and the pressure rollers are disengaged from the upper and lower punches. The bearing block for the upper pressure roller is connected to the upper crossbeam by means of an adjustable spacer. The spacer is used to set the depth of penetration of the upper punches into the dies of the die disk. The bearing block for the lower pressure roller is connected via a shaft to a hydraulic adjusting unit, which acts on the lower pressure roller for the purpose of setting the tablet thickness. The drawback is that the pressing force passes over the press frame and that the mounting of the bearing blocks for the pressure rollers at the two vertical columns and at the frame pivotable in the press frame is soft and elastic, so that the prior-art pressure roller unit can be used for weak pressing forces only.

SUMMARY AND OBJECTS OF THE INVENTION

The basic object of the present invention is therefore to improve the pressure roller unit of this type.

To accomplish this object, the present invention provides for the frame formed from a guide column and bearing blocks arranged at jointly adjustable upper and lower pressure roller mounts guided by the guide column. As a result, a pressure roller unit which can be used to absorb strong pressing forces is created, whose guide column can be designed as an extremely stable guide column, and the pressing force is prevented from passing over the press frame. Furthermore, the upper and lower pressure roller mounts may be adjusted not only independently from one another, but also together, in order to thus make possible the adjustment of the pressing zone in the case of the parallel adjustment of both pressure roller mounts at a fixed distance from another, or the adjustment of the web height for setting the tablet thickness in the case of the setting of the lower pressure roller mount in relation to the upper pressure roller mount.

In the preferred embodiment, the guide column and the pressure roller mounts have a cylindrical design and the pressure roller mounts are mounted in the guide column. Thus, this forms the housing of the pressure roller unit at the same time.

In another embodiment of the present invention, the upper pressure roller mount is provided with an upper adjusting drive acting on the guide column, and the lower pressure roller mount is provided with a lower adjusting drive, which is mounted in the upper pressure roller mount and acts on same.

Furthermore, the guide column is mounted vertically upright on a frame plate of the rotary press and can be set and locked by means of an adjusting drive. This design and arrangement of the pressure roller unit is possible, because the pressing forces of both pressure rollers are absorbed exclusively by the guide column, and this guide column can thus be arranged freely on a component standing on a massive, rigid and twisting-resistant frame plate of the rotary press.

The various features of the novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
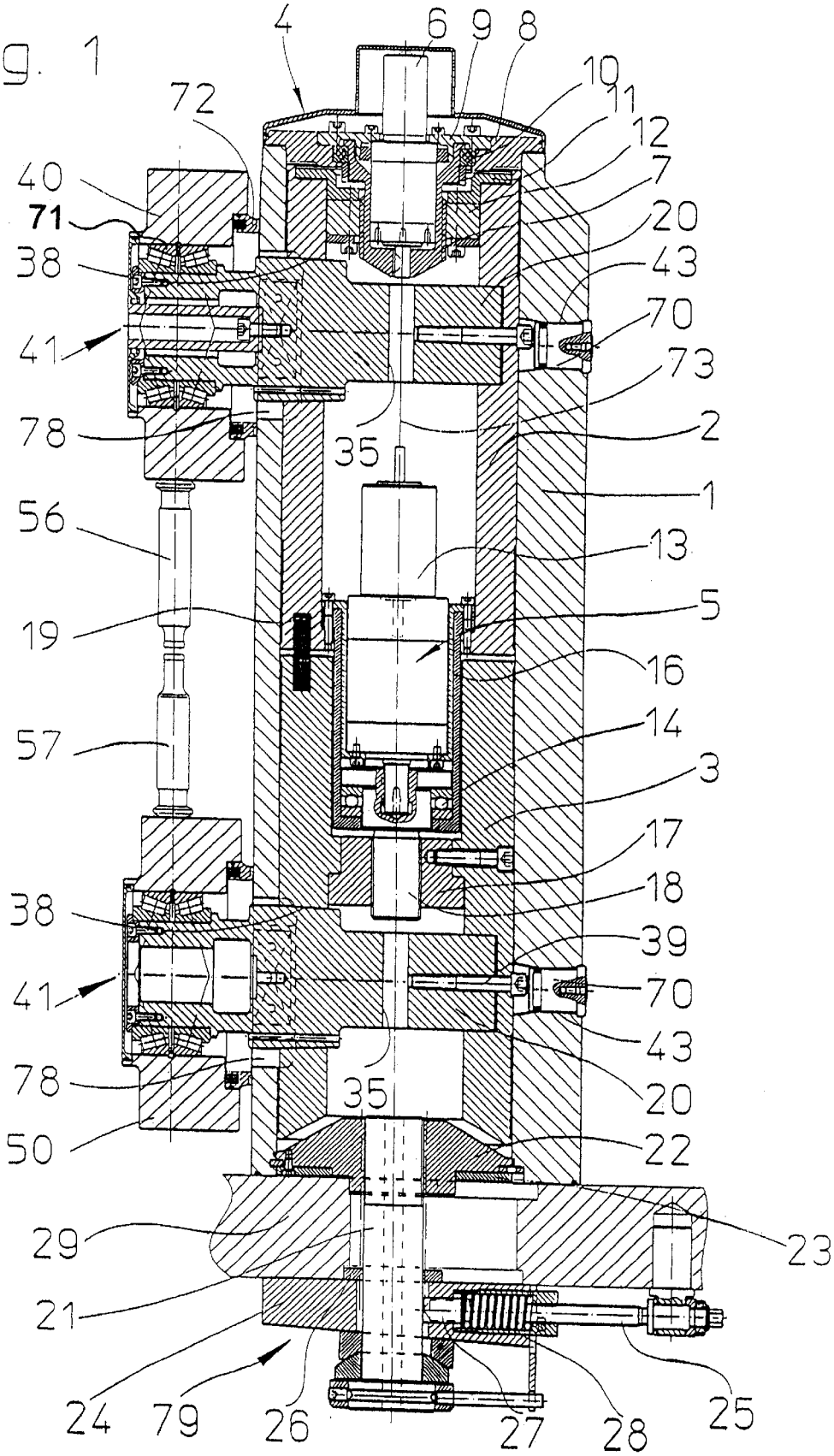
FIG. 1 is a vertical sectional view taken through the pressure roller unit.

The pressure roller for rotary tabletting presses comprises a massively designed guide column 1 of cylindrical cross section, in the cylindrical interior space of which a likewise cylindrical and hollow, upper pressure roller mount 2 and a cylindrical and internally hollow, lower pressure roller mount 3 are slidably mounted, wherein the upper and lower pressure roller mounts 2, 3 are likewise of a massive and stable design. The adjusting drive 4 for the upper pressure roller 40 is arranged in the upper area of the guide column 1, and the adjusting drive 5 for the lower pressure roller 50 is arranged in the middle area of the guide column 1. The upper adjusting drive 4 is used for setting the upper pressure roller 40 and thus the depth of penetration of the upper punch 56, on which the upper pressure roller 40 acts, and for adjusting the upper and lower pressure rollers 40 and 50, respectively, jointly, i.e., in parallel, at a fixed distance and thus for adjusting the pressing zone. The adjusting drive 5 for the lower pressure roller 50 is used to set the tablet thickness in relation to the upper pressure roller 40.

Figure 2:
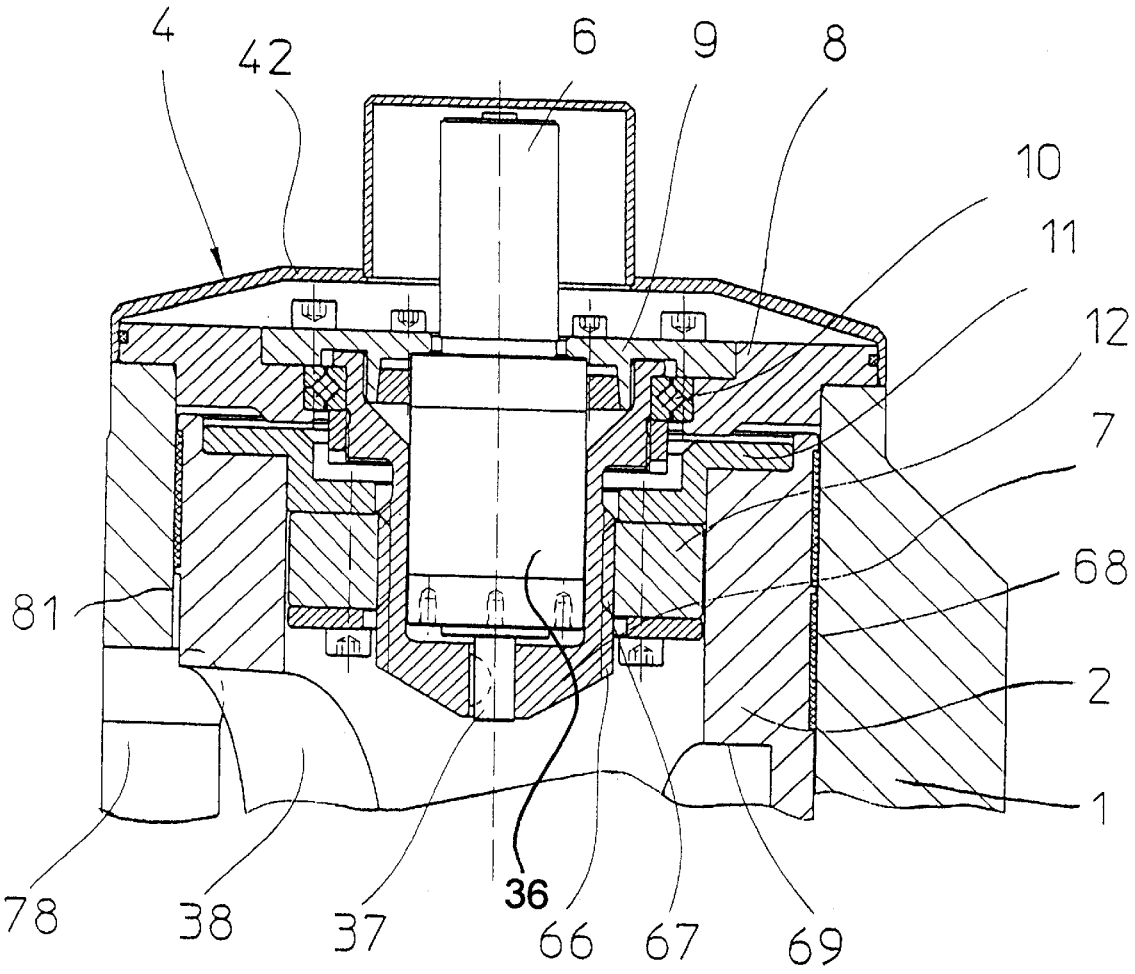
FIG. 2 is an enlarged vertical sectional view taken through the upper adjusting drive.

The upper adjusting drive 4 shown in FIG. 2 on a larger scale contains a gear motor 6 with a gearbox 36 and power take-off shaft 37. The gear motor 6 is surrounded by a closing cover 42 closing off the guide column 1 in the upward direction, as well as a pot-shaped spindle 7, which is connected to the power take-off shaft in a non-positive matter. The pot-shaped spindle 7 has external teeth 66 which mesh with the internal teeth 67 of a spindle nut 12 fixed in the cylindrical upper pressure roller mount 2. To mount the gear motor 6 and the gearbox 36, two disks 8, 9 are screwed to the upper end of the guide column 1. The disk 9 carries the gear motor 6 and the gearbox 36, and the outer bearing ring of a bearing 10 is clamped between the two disks 8, 9, and the inner bearing ring of said bearing 10 carries the upper circumferential edge of the pot-shaped spindle 7. The pot-shaped spindle 7 is thus freely rotatable in relation to the disks 8, 9 and the gearbox 36 enclosed inside. The spindle nut 12 is screwed to a flange 11, which in turn is screwed to the top side of the cylindrical upper pressure roller mount 2. The likewise hollow cylindrical upper pressure roller mount 2, which is slidable in the inner cylindrical hole 81 of the guide column 1 by means of sliding elements 68, can thus be moved vertically adjustably within the guide column 1 by actuating the gear motor 6 and in cooperation with the rotatable spindle 7 and the fixed spindle nut 12.

On the side shown on the left in FIGS. 1 and 2, the upper pressure roller mount 2 has a passage opening 38, in which the massive bearing block 20 for the upper pressure roller 40 is mounted, wherein the end of the bearing block 20, which is the right-hand end in FIG. 1, is inserted into an inner recess 69 on the inside of the cylindrical upper pressure roller mount 2 by means of a screw 39. In the area of the head of the screw 39, a mounting opening 43, which is closed by a plug 70, is provided within the cylindrical guide column 1. On the outer side of the guide column 1, which is the left-hand outer side in FIG. 1, the pressure roller axle 20 carries the upper pressure roller 40 acting on the upper punch 56 with the pressure roller mount 41 comprising two angular ball bearings 71. A sealing ring 72 cooperating with the rear side of the upper pressure roller 40 is arranged on the outside of the guide column 1 facing the upper pressure roller 40. The pressure roller axle 20 of the upper pressure roller 40 has a hole 35 for manual adjustment in the central axis 73.

Figure 3:
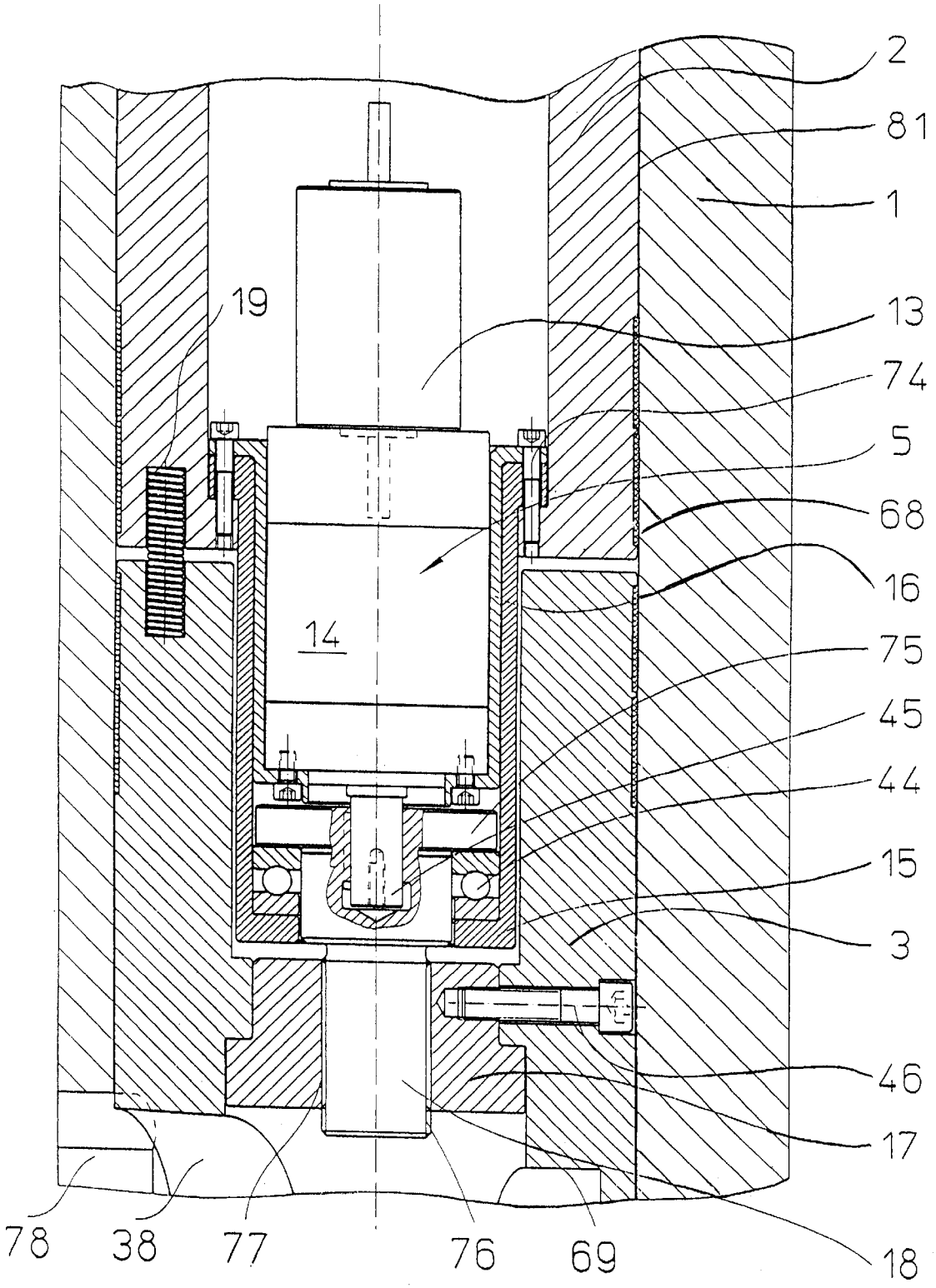
FIG. 3 is an enlarged vertical sectional view taken through the lower adjusting drive.

The adjusting drive 5 for the lower pressure roller 50, which is shown on a larger scale in FIG. 3, contains a gear motor 13 with gearbox 14, which is mounted in the gearbox flange 16, which in turn is mounted in an axially longer mounting sleeve 15, wherein the gearbox flange 16 and the mounting sleeve 15 are tightened with screws 74 in the lower area of the upper pressure roller mount 2. The mounting sleeve 15 dips with its outer circumference freely into the top end of the lower pressure roller mount 3, which has a hollow cylindrical design, just as the upper pressure roller mount 2. The drive shaft 45 of the transmission formed by the gear motor 13 and the gearbox 14 engages a spindle 18 through a clutch disk 75, which lies on the upper bearing ring of a ball bearing 44, and the external teeth 76 of the spindle 18 mesh with the internal teeth of a spindle nut 17 fixed in the lower pressure roller mount 3 by means of screws 46. By actuating the gear motor 13, the cylindrical lower pressure roller mount 3, which is slidably mounted in the inner hole 81 of the guide column 1 by means of nonskid elements 68, like the cylindrical upper pressure roller mount 2, can thus be moved vertically slidably and adjustably within the guide column 1 by means of the adjusting drive 5 shown in FIG. 3. This adjusting movement is used to adjust the web height or to set the tablet thickness in relation to the upper pressure roller 40. FIG. 3 also shows that compression springs 19 are inserted between the upper pressure roller mount 2 and the lower pressure roller 3.

The pressure roller axle 20 of lower pressure roller mount 41 is inserted under the adjusting drive 5 in a passage opening 78 in the lower pressure roller mount 3 of the pressure roller axle 20 for the lower pressure roller 50, and the right-hand end of this pressure roller axle 20 of lower pressure roller mount 41 shown in FIG. 1 is in turn clamped by means of a screw 39 in a recess 69 on the inside of the lower pressure roller mount 3, wherein a corresponding mounting hole 43 is closed by means of a plug 70. The lower pressure roller 50 is also mounted on the corresponding pressure roller axle 20 by means of a pressure roller mount 41 formed by angular ball bearings 71 and is sealed by means of a sealing ring 72. The lower pressure roller 50 cooperates with the lower punches 56.

Figure 4:
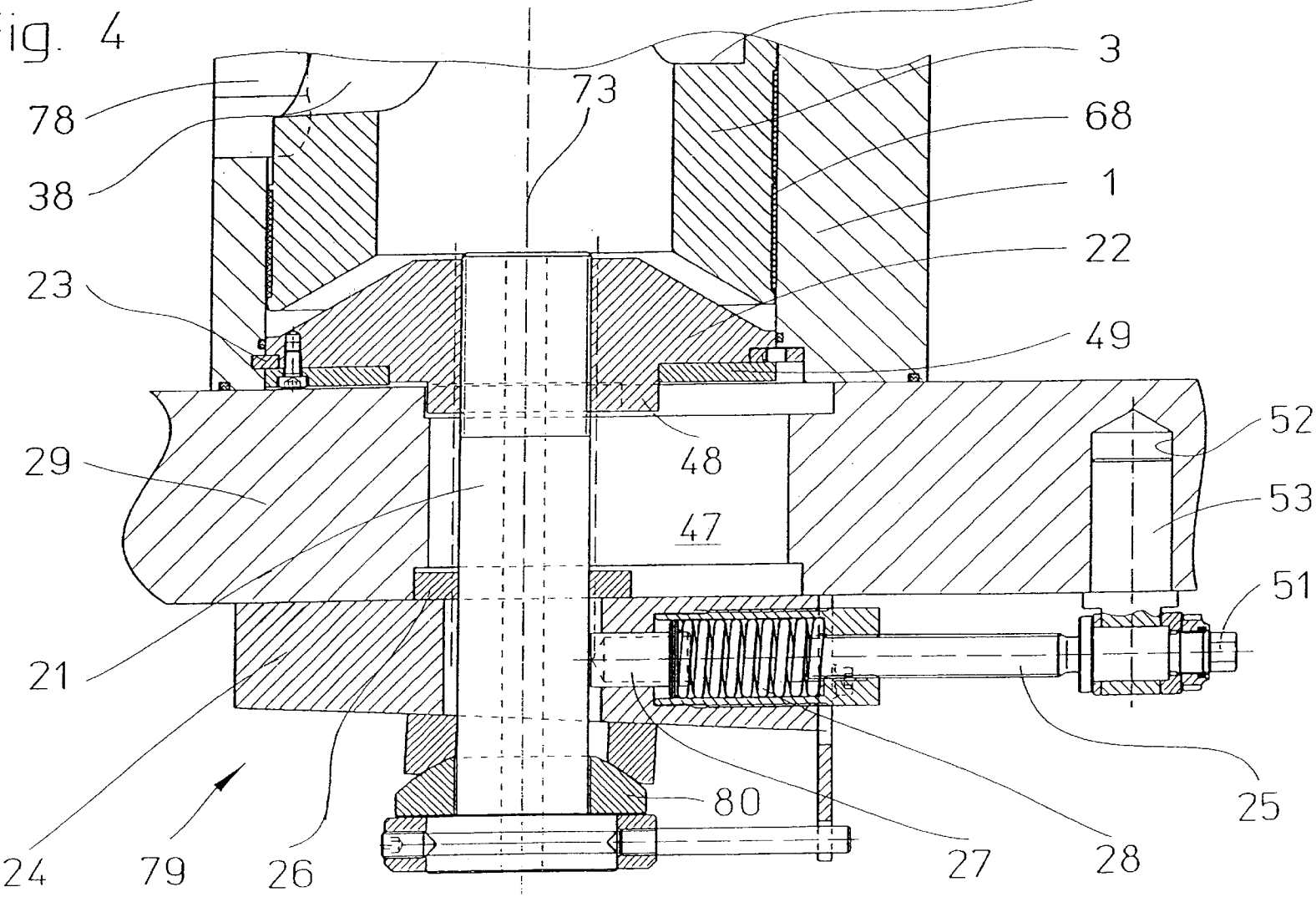
FIG. 4 is a vertical sectional view taken through the adjustable mounting of the pressure roller unit on a frame plate.

The pressure roller unit shown in FIG. 1 is mounted with its guide column 1 vertically upright on a massive base plate 29 of the rotary tabletting press and is movable by means of a horizontally operating adjusting drive 79, which is shown on a larger scale in FIG. 4. A truncated cone-shaped mounting flange 22 is fixed within the lower end of the guide column 1 by means of three ring segments 23 distributed over the circumference and of additional ring elements 49. A tie rod 21, which passes through a projection 48 at the lower end of the truncated cone-shaped mounting flange 22, is screwed into the mounting flange 22 within the central axis 73 of the guide column 1, and the tie rod is movable within an elongated hole 47, which is provided in the massive base plate 29 of the rotary tabletting press. The tiered 21 passes through the wedge 24 within the stop ring 26 under the base plate 29, and the stop ring 26 is held by the T-shaped head of the tie rod 21 by means of a dome-shaped piece 80. The wedge 24 can be loosened and tightened by means of a spindle 25, which is located rotatably and horizontally nondisplaceably in a vertical bolt 53 at the free end, which is inserted into a vertical blind hole 52 on the underside of the base plate 29. The spindle 25 has a spindle head 51 on its face. It is connected to a pressure piece 27 acting on the tie rod 21 via a compression spring 28. For locking, the spindle 25 is rotated at the spindle head 51 until the projection 48 of the mounting flange 22 and the stop ring 26 at the end of the elongated hole 47, which is the left-hand end in FIG. 4, come into contact with base plate 29. Under the action of the compression spring 28, the spindle 25 now presses the pressure piece 27 against the spindle 21. The wedge 24 is displaced at the same time to the left in FIG. 4 such that the guide column 1 becomes firmly seated on the top side of the base plate 29 of the rotary tabletting press by means of the tie rod 21.

To pull the pressure roller unit and thus the pressure rollers 40, 50 forward from the engagement area of the upper and lower punches 56 and 57, respectively, the spindle 25 is rotated in the opposite direction by means of the spindle head 51, the compression spring 28 is released, and the wedge 24 is moved away from the stop ring 26 by a small amount, so that the guide column 1 is released from its fixed tensioning at the base plate 29 and can be pulled to the right in FIG. 4 by continuing to actuate the spindle 25.

Figure 5:
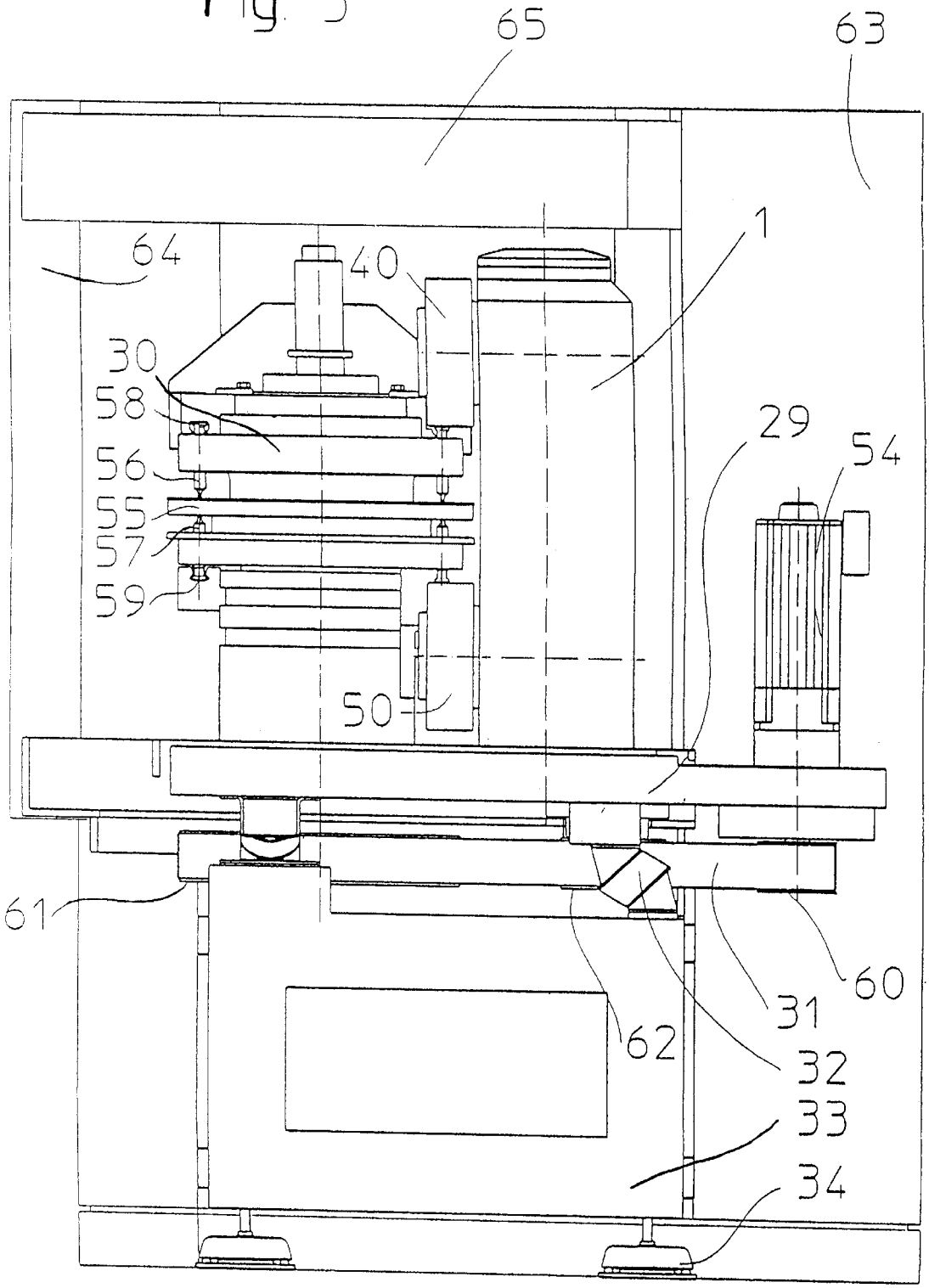
FIG. 5 is a view of a rotary tabletting press with the pressure roller unit.

FIG. 5 shows a view of the entire rotary tabletting press, in which the pressure roller unit comprising the guide column 1 and the upper and lower pressure rollers 40 and 50, respectively, is placed on the base plate 29 and FIG. 5 shows that the pressing force from the rollers 40, 50 is transmitted through the guide column 1 to the one end of the guide column connected to the base plate 29. The upper and lower punches 56 and 57 engage dies of the die plate 55, not shown. The respective upper and lower pressure rollers 40 and 50 act on the respective punch heads 58 and 59 during the rotation of the die plate 55 of the rotor 30. The rotor 30 is driven via a drive motor 54, a toothed belt 31 and two belt pulleys 60 and 61, as well as a tightening disk 62. The massive base plate 29 accommodating the pressure roller 1, the rotor 30 and the drive motor 54 is mounted on the base frame 33 of the rotary tabletting press by means of a plurality of rubber-bonded-to-metal mountings 32, the rotary tabletting press being carried by frame legs 34 at the installation site. The rotary tabletting press also contains non-carrying frame parts 63, 64 and 65, which are used to accommodate the press control and the encapsulation of the rotor 30 and of the pressure roller unit 1.

While specific embodiments of the invention have been shown and described in detail to illustrate the application of the principles of the invention, it will be understood that the invention may be embodied otherwise without departing from such principles.

| LIST OF REFERENCE NUMBERS | |
|---|---|
| 1 | Guide column |
| 2 | Upper pressure roller mount |
| 3 | Lower pressure roller mount |
| 4 | Adjusting drive for depth of penetration |
| 5 | Adjusting drive for tablet thickness |
| 6 | Gear motor |
| 7 | Spindle (pot-shaped) |
| 8, 9 | Disk |
| 10 | Bearing |
| 11 | Flange |
| 12 | Spindle nut |
| 13 | Gear motor |
| 14 | Gearbox |
| 15 | Mounting sleeve |
| 16 | Gearbox flange |
| 17 | Spindle nut |
| 18 | Spindle |
| 19 | Compression spring |
| 20 | Pressure roller axle |
| 21 | Tie rod |
| 22 | Mounting flange |
| 23 | Ring segment |
| 24 | Wedge |
| 25 | Spindle |
| 26 | Stop ring |
| 27 | Pressure piece |
| 28 | Compression spring |
| 29 | Base plate |
| 30 | Rotor |
| 31 | Toothed belt |
| 32 | Rubber-bonded-to-metal mounting |
| 33 | Base frame |
| 34 | Frame leg |
| 35 | Hole for manual adjustment |
| 36 | Gearbox |
| 37 | Drive shaft |
| 38 | Passage opening |
| 39 | Screw |
| 40 | Upper pressure roller |
| 41 | Pressure roller mount |
| 42 | Closing cover |
| 43 | Mounting opening |
| 44 | Bearing |
| 45 | Drive shaft |
| 46 | Screw |
| 47 | Elongated hole |
| 48 | Projection |
| 49 | Ring element |
| 50 | Lower pressure roller |
| 51 | Spindle head |

-continued

| LIST OF REFERENCE NUMBERS | |
|---|---|
| 52 | Hole |
| 53 | Bolt |
| 54 | Drive motor |
| 55 | Die plate |
| 56 | Upper punch |
| 57 | Lower punch |
| 58, 59 | Punch head |
| 60, 61, 62 | Belt pulley |
| 63, 64, 65 | Frame parts |
| 66 | External teeth |
| 67 | Internal teeth |
| 68 | Sliding element |
| 69 | Recess |
| 70 | Plug |
| 71 | Angular ball bearing |
| 72 | Sealing ring |
| 73 | Central axis |
| 74 | Screw |
| 75 | Clutch disk |
| 76 | External teeth |
| 77 | Internal teeth |
| 78 | Passage opening |
| 79 | Adjusting drive |
| 80 | Dome-shaped piece |
| 81 | Hole |

What is claimed is:

1. A pressure roller unit for rotary tablet presses, comprising:

pressure rollers;

a guide column with an end;

two bearing blocks adjustably connected to said guide column, said bearing blocks carrying said pressure rollers, said bearing blocks being arranged at upper and lower pressure roller mounts, said pressure roller mounts being guided by said guide column and being adjustable in relation to one another, said upper and lower pressure roller mounts and said guide column being formed to cancel pressing force from said pressure rollers in said guide column, said guide column being supported only through said one end of said guide column.

2. The pressure roller unit in accordance with claim 1, wherein said guide column and said pressure roller mounts have a cylindrical design, and said pressure roller mounts are mounted in said guide column.

3. The pressure roller unit in accordance with claim 1, wherein said guide column is provided with an upper adjusting drive acting on said upper pressure roller mount, and said upper pressure roller mount is provided with a lower adjusting drive mounted in said upper pressure roller mount and acts on said lower pressure roller mount.

4. The pressure roller unit in accordance with claim 3, wherein said upper adjusting drive comprises:

a gear motor;

a gearbox connected to said gear motor;

a power take-off shaft connected to said gear box; and a pot-shaped spindle connected to said power take-off shaft, said spindle having external teeth;

a spindle nut fixed in said upper pressure roller mount, said upper pressure roller mount being cylindrical, said spindle having external teeth meshing with internal teeth of said spindle nut.

5. The pressure roller unit in accordance with claim 3, wherein said upper adjusting drive comprises:

a gear motor;

a gearbox connected to said gear motor;

a power take-off shaft connected to said gear box; and a spindle driven by said power take-off shaft, said spindle having external teeth;

a spindle nut fixed to said upper pressure roller mount, said spindle nut having internal teeth meshing with said external teeth of said spindle.

6. The pressure roller unit in accordance with claim 1, further comprising:

a base plate, said guide column being mounted vertically upright on said base plate; and a guide column adjusting drive, said guide column being adjustable and lockable by means of said guide column adjusting drive.

7. The pressure roller unit in accordance with claim 6, wherein said guide column adjusting drive includes:

a mounting flange fixed within a lower end of said guide column;

a tie rod screwed into said mounting flange, said tie rod passing through said base plate;

a stop ring, said tie rod passing through said stop ring;

a spindle; and a wedge in contact with said base plate, said wedge being loosened and tightened by means of said spindle.

8. A pressure roller unit for rotary tablet presses, comprising:

a guide column having only one end connected to a base frame of the rotary tablet press;

a first pressure roller mount movably connected to said guide column;

a first pressure roller connected to said first pressure roller mount, said first pressure roller engaging with a first set of punches of said rotary tablet press, said first pressure roller mount being formed to transmit pressing force from engagement of the first set of punches with said first pressure roller to said first pressure roller mount;

a second pressure roller mount movably connected to said guide column and movable in said guide column with respect to said first pressure roller mount;

a second pressure roller connected to said second pressure roller mount, said second pressure roller engaging with a second set of punches of said rotary tablet press, said second pressure roller mount being formed to transmit pressing force from engagement of the second set of punches with said second pressure roller to said second pressure roller mount, said first and second mounts being connected to have said pressing forces from said first and second set of punches cancel within said guide column.

9. The pressure roller unit in accordance with claim 8, further comprising:

an adjusting drive for moving said first and second pressure roller mounts together with respect to said guide column.

10. The pressure roller unit in accordance with claim 9, further comprising:

another adjusting drive for moving said second pressure roller mount with respect to said first pressure roller mount.

11. The pressure roller unit in accordance with claim 8, further comprising:

a base plate mounted on said base frame of the rotary tablet press;

a guide column adjusting drive connected to said base plate and said end of said guide column for moving said guide column with respect to said base plate and locking said guide column to said base plate.

12. The pressure roller unit in accordance with claim 10, further comprising:

a base plate mounted on the base frame of the rotary tablet press;

a guide column adjusting drive connected to said base plate and said end of said guide column for moving said guide column with respect to said base plate and locking said guide column to said base plate.

13. The pressure roller unit in accordance with claim 8, wherein:

said guide column exclusively transmits any remaining said pressing force from said pressure rollers through said end of said guide column.

14. A pressure roller unit for rotary tablet presses, comprising:

pressure rollers;

a guide column with an end;

two bearing blocks adjustably connected to said guide column, said bearing blocks carrying said pressure rollers, said bearing blocks being arranged at upper and lower pressure roller mounts, said pressure roller mounts being guided by said guide column and being adjustable in relation to one another, said upper and lower pressure roller mounts and said guide column being formed to cancel pressing force from said pressure rollers in said guide column, said guide column being supported only through said one end of said guide column, said guide column and said pressure roller mounts having a cylindrical design, and said pressure roller mounts being mounted in said guide column.

* * * * *